United States Patent [19]

Sakaguchi et al.

[11] Patent Number: 4,737,806

[45] Date of Patent: Apr. 12, 1988

[54] APPARATUS FOR FLASH PHOTOGRAPHING

[75] Inventors: Toru Sakaguchi, Tokyo; Akira Takahashi, Kawasaki; Akira Ueno, Tokyo, all of Japan

[73] Assignee: Ricoh Company, Ltd., Tokyo, Japan

[21] Appl. No.: 35,928

[22] Filed: Apr. 8, 1987

[30] Foreign Application Priority Data

Apr. 8, 1986 [JP] Japan ..... 61-51426[U]

[51] Int. Cl.[4] ..... H05B 41/32

[52] U.S. Cl. ..... 354/145.1; 315/241 P

[58] Field of Search ..... 354/145.1, 484, 418; 354/127.1, 127.11, 127.12; 315/241 P

[56] References Cited

U.S. PATENT DOCUMENTS

| | | | |
|---|---|---|---|
| 4,023,068 | 5/1977 | Harvey | 354/145.1 |
| 4,430,602 | 2/1984 | Ohmori | 315/241 P |
| 4,479,076 | 10/1984 | Yamaoka et al. | 315/241 P |

*Primary Examiner*—L. T. Hix
*Assistant Examiner*—David M. Gray
*Attorney, Agent, or Firm*—Oblon, Fisher, Spivak, McClelland & Maier

[57] ABSTRACT

An apparatus for conducting flash photographing by a camera capable of incorporating or setting therein a flashlight device and generating a trigger signal at full opening of a shutter, and a capacitor adapted to release electric charge stored therein in response to said trigger signal for a flash discharge tube to emit flash.

1 Claim, 7 Drawing Sheets

APPARATUS FOR FLASH PHOTOGRAPHING

This invention relates to an apparatus for flash photographing. More particularly, this invention relates to an apparatus for flash photographing comprising a camera capable of incorporating or setting therein a flashlight and generating a trigger signal when a shutter is fully opened, and a flashlight which discharges the electric charge stored in advance in a main capacitor in response to the aforementioned trigger signal to induce emission of a flash from a flash discharge tube.

In the conventional apparatus for flash photographing, the main capacitor is charged with the output voltage from a DC.DC converter which serves to increase the voltage of a battery possessing an output voltage on the order of several volts to a level of several hundred volts.

In the apparatus of this kind, the interval between starting and completing the charging can be shortened by setting the output voltage of the DC.DC converter larger. (as disclosed in Japanese Patent disclosure SHO 59(1984)-23,498, for example).

The conventional apparatus for flash photographing designed as described above, therefore, has a disadvantage that this apparatus inevitably becomes expensive because a voltage detection circuit for stopping and regulating oscillation of the DC.DC converter is required to have a high operational accuracy enough to avoid exerting adverse effects upon the circuit of the flashlight.

Optionally, for the purpose of avoiding the disadvantage mentioned above, the apparatus could be designed without very high accuracy for oscillation control by setting the output voltage of the DC.DC converter at a lower level. However, it would be unpractical because the interval between starting and completing the charging of the main capacitor becomes very long.

The purpose of this invention is to provide an apparatus for flash photographing which completes the charging of a main capacitor thereof with a simple circuit and in a short interval without inflicting any damage upon a flash discharge tube and the main capacitor.

The purpose described above is accomplishes by an apparatus for flash photographing for conducting said flash photographing by a camera capable of incorprating or setting therein a flashlight device and generating a trigger signal at full opening of a shutter, and a capacitor adapted to release electric charge stored therein in response to said trigger signal for a flash discharge tube to emit, said apparatus comprising;

A DC.DC converter for charging said capacitor by increasing voltage of a power source battery, a first timer adapted to be actuated when charging of said capacitor is started or when charging voltage reaches a predetermined level and set for a time at which charging voltage reaches upper limit voltage below withstand voltage of the flash discharge tube for initial charge, a second timer adapted to be actuated when charging voltage reaches said upper limit voltage and set for the time at which charging voltage reaches lower limit voltage for proper emission according to spontaneous discharge, a third timer adapted to be actuated when charging voltage is below the lower limit voltage and set for a time at which charging voltage reaches a level between the lower limit voltage and withstand voltage, and oscillation regulating means for turning said DC.DC converter off with output of said first timer, turning said DC.DC converter on with output of said second timer, and turning said DC.DC converter off with output of said third timer.

The apparatus of this invention for flash photographing is designed so as to regulate the charging of the main capacitor with a timer circuit as described above, this timer circuit can be formed with a simplified digital circuit.

Thus, such an analog circuit with a high-accuracy voltage comparison circuit indispensable to the conventional apparatus is not necessary. Since the timer circuit can be formed with an inexpensive and integrated control circuit, the apparatus for flash photographing can be formed in a small size and at a low cost.

Further, since it is possible to charge the main capacitor accurately by the timer circuit, the main capacitor and the flash discharge tube cannot be damaged even if the period required for completely charging the main capacitor is shortened by setting output voltage of the DC.DC converter at a higher level.

Moreover, the apparatus of this invention for flash photographing is such that even if the indication of completion of charging by a neon lamp has a hysteresis, it never fails to prevent the accident that the flash photography is conducted with insufficient supply of luminous energy and an inferior photographing is resulted. The operation of the apparatus for flash photographing according to the present invention will be described by referring to FIGS. 1 through 11.

FIG. 9 illustrates a typical conventional apparatus for flash photographing wherein a main capacitor as a source of luminous energy is charged with the output voltage of a DC.DC converter which serves to increase the voltage of a battery with the output voltage on the order of several volts to about several hundreds volts.

Figure 9:
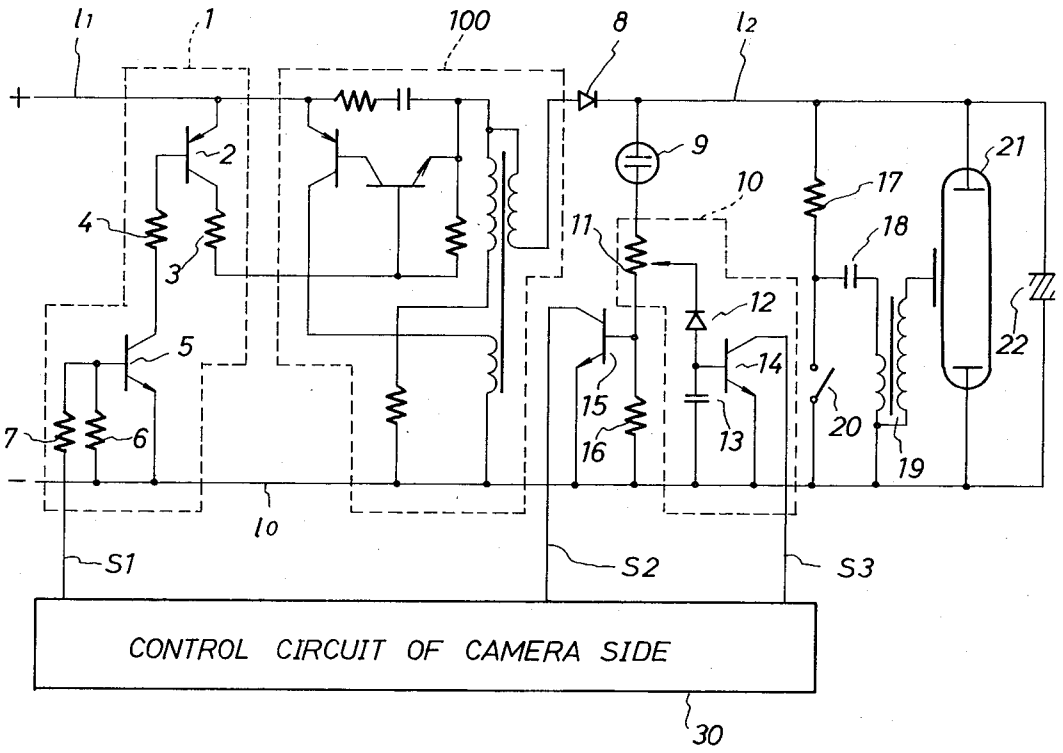
Fig. 9 PRIOR ART
FIG. 9 is a schematic diagram of the conventional apparatus for flash photographing.

As illustrated in FIG. 9, the plus (+) pole of a power source battery (not shown) possessing an output voltage of about several volts is connected to a power source feed line $l_1$ and minus (−) pole thereof to a common line $l_0$. Between these lines $l_1$ and $l_0$, an oscillation selection circuit 1 and a DC.DC converter 100 are connected. The oscillation selection circuit 1 is provided with a PNP type transistor 2, the emitter thereof is connected to the line $l_1$ and the collector is connected via a resistor 3 to the ON-OFF control terminal of the DC.DC converter 100. The base of this transistor 2 is connected via a resistor 4 to the collector of an NPN type transistor 5. The emitter of this transistor 5 is connected to the line $l_0$, and between this emitter and the base a resistor 6 is connected. To this base, an oscillation control signal S1 transmitted from control circuit 30 of a camera side is supplied via a resistor 7.

The output terminal of the DC.DC converter 100 is connected via a rectifying diode 8 to a line $l_2$. This line $l_2$ is connected to the line $l_0$ via a neon lamp 9 for indicating completion of charging, a variable resistor 11 of a voltage detection circuit 10 and a resistor 16. The node of the variable resistor 11 and the resistor 16 is connected to the base of an NPN type transistor 15. The emitter of the transistor 15 is connected to the line $l_0$. From the collector of this transistor, a first voltage detection signal S2 is supplied to the control circuit 30 of the camera side.

The movable terminal of the variable resistor 11 is connected to the line $l_0$ via the cathode and anode of a zener diode 12 and a capacitor 13. The node of the zener diode 12 and the capacitor 13 is connected to the base of an NPN type transistor 14. The emitter of this transistor 14 is connected to the line $l_0$. A second voltage detection signal S3 from the collector of the transistor 14 is supplied to the control circuit 30 of the camera side.

Between the lines $l_2$ and $l_0$, a series circuit composed of a resistor 17, a trigger capacitor 18, and the primary coil of a trigger transformer 19 is connected. Between the node of the resistor 17 and the trigger capacitor 18 and the line $l_0$, a trigger switch 20 adapted to be turned on synchronously when a shutter is fully opened, is connected.

The discharge electrodes of the flash discharge tube 21 are connected to the line $l_2$ and $l_0$ respectively. To the trigger electrode of this flash discharge tube 21, the secondary coil of the trigger transformer 19 is connected. Further between the lines $l_2$ and $l_0$, a main capacitor 22 serving as a luminous energy source for flash is connected.

In the apparatus for flash photographing constituted as described above, when the oscillation control signal S1 from the control circuit 30 of camera side reaches an H level, the transistor 5 is turned on. Since the base of the transistor 2 is consequently caused to be of an L level, the transistor 2 is turned on and the DC.DC converter 100 begins to increase the voltage. The high output voltage of the DC.DC converter 100 is rectified by the diode 8 to bring about the predetermined output voltage on the line $l_2$ and start the charging of the main capacitor 22.

Figure 10:
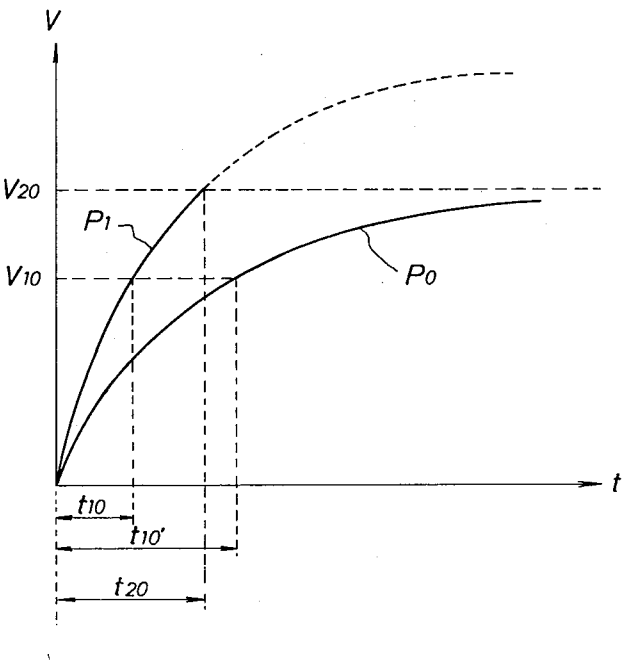
Fig.10 PRIOR ART
FIG. 10 is a schematic diagram used for explanation of the operation of the apparatus for flash photographing illustrated in FIG. 9.

Then, the voltage, V, of the main capacitor 22 is gradually increased along the curve $P_1$ in FIG. 10. When this voltage reaches a lower limit voltage $V_{10}$ for proper flash, the neon lamp 9 is turned on. Since the base potential of the transistor 15 is consequently increased, this transistor 15 is turned on and the first voltage detection signal S2 is brought to the L level. Then the charging of the capacitor 13 constituting the voltage detection circuit 10 is started. Consequently, the base potential of the transistor 14 is increased and this transistor is turned on. The voltage in this case is set at an upper limit voltage, $V_{20}$, below the withstand voltage of the flash discharge tube 21 and the main capacitor 22. The second voltage detection signal S3 of the voltage detection circuit 10 is brought to the L level.

Figure 11:
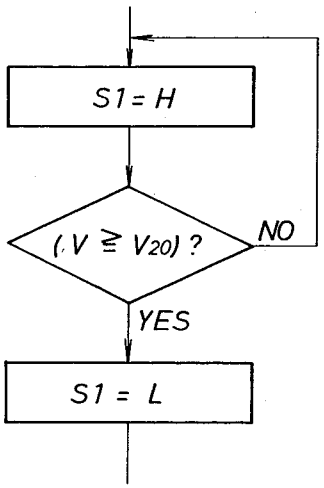
Fig.11 PRIOR ART
FIG. 11 is a flow chart illustrating the operation of the conventional apparatus for flash photographing.

The second voltage detection signal S3 of the L level is supplied into the control circuit 30 of camera side. In the circuit 30 of camera side, the oscillation control signal S1 supplied to the oscillation selection circuit 1 is consequently changed to the L level. As a result, the transistor 5 is turned off and the transistor 2 is turned off, then DC.DC converter 100 is caused to cease its oscillating operation (see the flow chart of FIG. 11).

Incidentally, the apparatus for flash photographing constituted as described above can shorten the time, $t_{20}$, between the moment at which the charging is started and the moment at which the charging voltage is brought to the upper limit voltage, $V_{20}$, by setting the output voltage of the DC.DC converter 100 at a level higher than the upper limit voltage $V_{20}$ (as disclosed in Japanese patent application Disclosure SHO 59(1984)-23,498, for example).

The conventional apparatus for flash photographing constituted as described above, therefore, has the disadvantage that this apparatus inevitably becomes expensive because the voltage detection circuit 10 used therein for stopping and regulating oscillation of the DC.DC converter 100 is required to possess high accuracy enough to avoid exerting adverse effects upon the circuit of the flashlight.

On the other hand, for avoiding the disadvantage mentioned above, the apparatus could be constituted without very high accuracy by setting the output voltage of the DC.DC converter at a level lower than the upper limit voltage $V_{20}$. The apparatus thus constituted, however, would be unpractical because the time, $t_{10}$, required for reaching the lower limit voltage $V_{10}$ for proper emission of flash is lengthened as shown by the charging characteristic represented by the curve $P_0$ in FIG. 10.

The first embodiment of this invention will be described with reference to FIG. 1 through FIG. 5.

Figure 1:
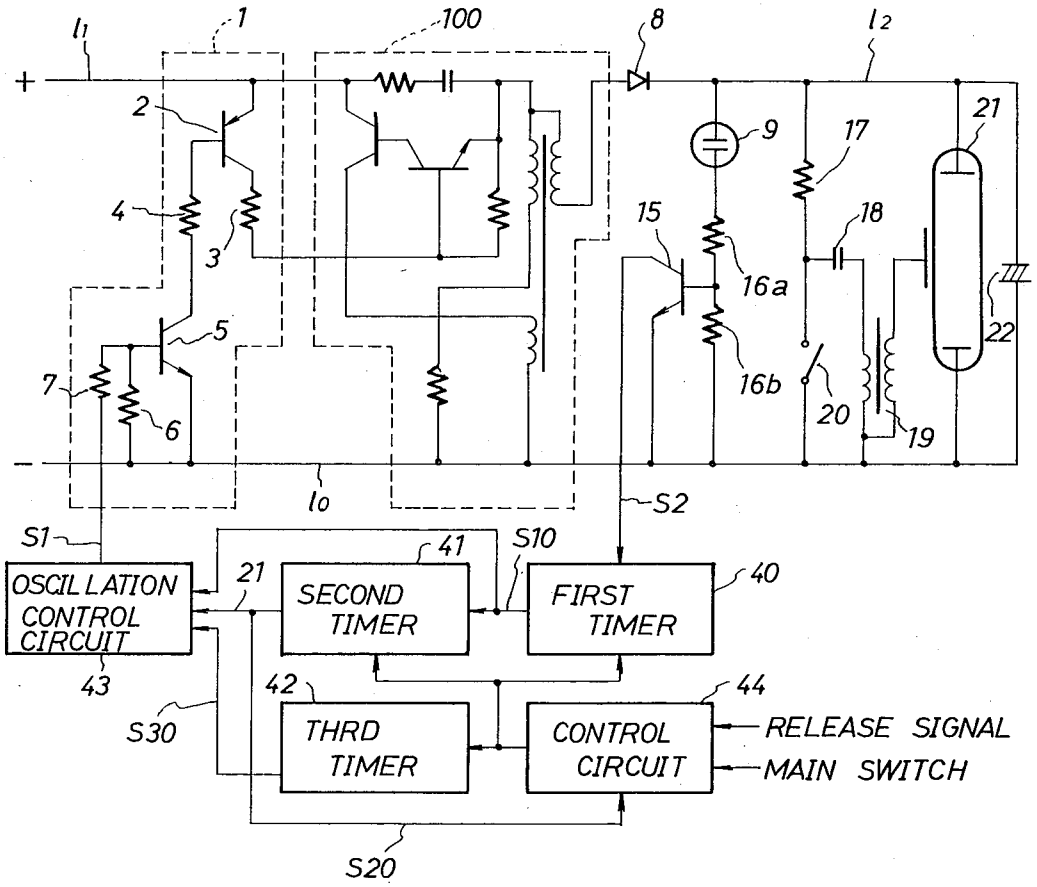
FIG. 1 is a diagram of a circuit of an apparatus for flash photographing as a first embodiment of the present invention.

As illustrated in FIG. 1, a series circuit composed of a neon lamp 9 and voltage-dividing resistors 16*a*, 16*b* are connected between lines $l_0$ and $l_2$. The common node of the voltage-dividing resistors 16*a*, 16*b* is connected to the base of a transistor 15.

Figure 2:
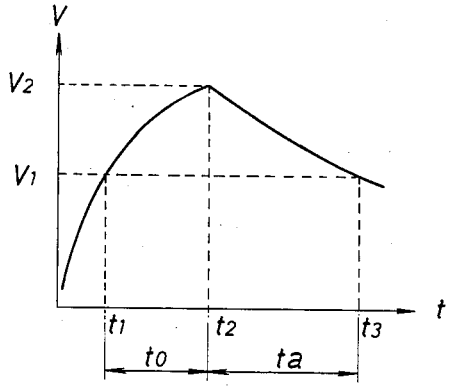
FIGS. 2 to 4 are diagrams used for explanation of the operation of the apparatus for flash photographing illustrated in FIG. 1.

The emitter of this transistor 15 is connected to the line $l_0$ and the collector thereof serves as an output terminal for supplying the first voltage detection signal S2 to a first timer 40. This first timer 40 is actuated at a point, $t_1$, at which the charged voltage of a main capacitor 22 reaches the lower limit voltage, $V_1$ for proper emission of flash as illustrated in FIG. 2 and is set previously for a time, $t_0$, corresponding to the interval between the point, $t_1$, and a point, $t_2$, at which the charged voltage reaches the upper limit voltage, $V_2$, below the withstand voltage of a flash discharge tube 21 and a main capacitor 22.

The output terminal of this first timer 40 is connected to the input terminal of a second timer 41. This second timer 41 is actuated at the point $t_2$ and is set previously for a time, $t_a$, corresponding to the interval between the point, $t_2$, and a point $t_3$, at which the charged voltage reaches the lower limit voltage, $V_1$, for proper emission of flash by spontaneous discharge. A control signal S20 which is generated at the output terminal of this second timer 41 is supplied to the oscillation control circuit 43 together with the control signal S10 from the first timer 40.

The oscillation control 43 which controls the ON-OFF status of the DC.DC converter 100 and the oscillation selection circuit 1 will be hereinafter referred to collectively as "oscillation control means."

The present apparatus is further provided with a third timer 42. This third timer 42 is enabled to start at the point $t_4$ in FIG. 3 if the voltage of the main capacitor 22 is under lower limit voltage $V_1$ and is set previously for a time, $t_b$, corresponding to the interval between the point, $t_4$, and a point, $t_5$, at which the voltage reaches a level between the lower limit voltage $V_1$ and the upper limit voltage $V_2$. A control signal S30 transmitted from this third timer 42 is supplied to the oscillation control circuit 43 as well.

The apparatus is further provided with a control circuit 44. In this control circuit 44, control signal S used for initial setting etc. is generated. The control signal S is supplied to the first through third timers 40–42. The signal S20 transmitted from the second timer 41 is supplied to the control circuit 44.

Figure 5:
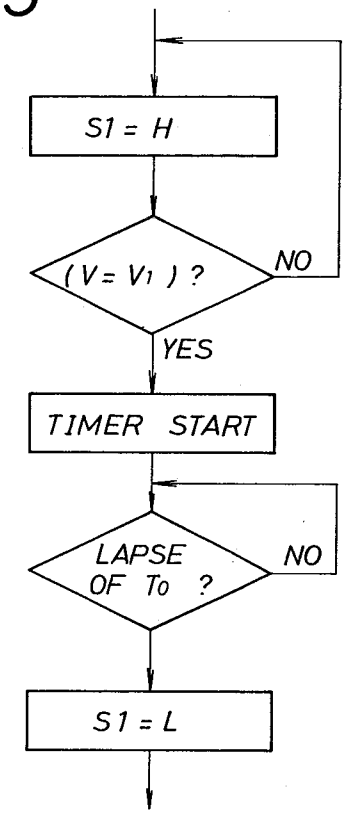
FIG. 5 is a flow chart illustrating the operation of the embodiment mentioned above.

Now, the operation of the apparatus for flash photographing of the present embodiment which is constituted as described above will be described with reference to the flow chart of FIG. 5.

In the initial state, the oscillation control signal S1 from the oscillation control circuit 43 is brought to the H level and the transistors 5, 2 are both turned on as described above and the DC.DC converter 100 starts oscillating. As a result, the charging of the main capacitor 22 with the output of the DC.DC converter 100 is started. The voltage V of the main capacitor is gradually increased. When this voltage V reaches the lower limit voltage $V_1$ the neon lamp 9 is turned on, and as a result, the divided voltage by the resistors **16*a*, 16*b* is increased and the base potential of the transistor 15 is increased. Thus, the transistor 15 is turned on and the first voltage detection signal S2 is brought to the L level. At this point, $t_1$, the first timer 40 is actuated. At the point, $t_2$, after elapse of a time $t_0$, the control signal S10 reaches the H level, and by the oscillation control circuit 43, the oscillation control signal S1 is brought to the L level and the DC.DC converter 100** is caused to stop the oscillating operation.

When a shutter release is made at the camera side within the time $t_a$, the trigger switch 20 being closed synchronously with full opening of the shutter generates a trigger signal which is supplied to the control circuit 44. At the same time, by the closing operation of this trigger switch 20, the charge in the capacitor 18 is instantaneously released to start emission of flash.

Figure 3:
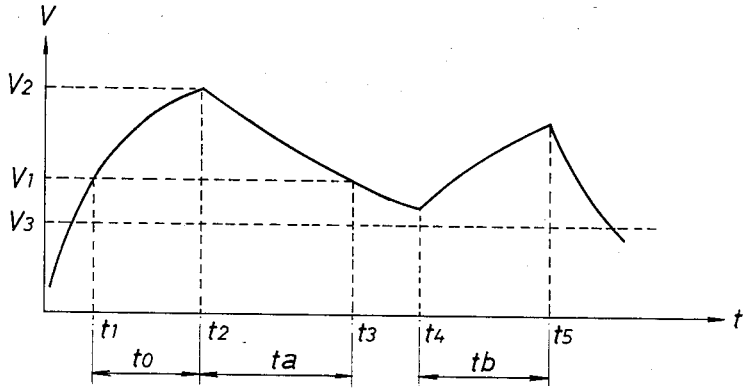

When the shutter release takes place at a point, $t_4$, after elapse of a time $t_a$, as illustrated in FIG. 3 and the voltage V of the main capacitor 22 is lower than the lower limit voltage $V_1$ proper for emission of flash, the third timer 42 is actuated by the control signal S transmitted from the control circuit 44 and the control signal S30 is brought to the H level, accordingly the oscillation control signal S1 from the oscillation control circuit 43 is brought to the H level. When the shutter release is made at this time, the DC.DC converter 100 is actuated again inhibiting the shutter from operating to recharge the main capacitor 22, the voltage of which has fallen through spontaneous discharge after the elapse of the time $t_a$ is gradually increased. The recharging operation continues for the time $t_b$ set previously in the third timer 42. At the point, $t_s$, after elapse of the time $t_b$, the control signal S30 is brought to the L level and the oscillation control signal S1 transmitted from the oscillation control circuit 43 is brought to the L level and, then, the DC.DC converter 100 is caused to stop the oscillating operation. At this time, the voltage V of the main capacitor 22 is at a level higher than the lower limit voltage $V_1$ proper for emission of flash and lower than the withstand voltage of the flash discharge tube 21. Therefore, when the shutter release is made again in this state, the flash photographing can be conducted with proper emission of flash.

Figure 4:
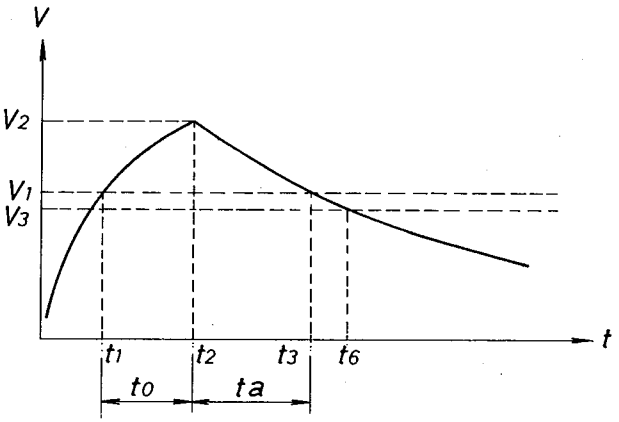

The neon lamp 9 has so-called hysteresis characteristic, i.e. the phenomenon that when applied voltage is increased to a certain flash starting voltage $V_1$, to induce an emission of flash by the neon lamp 9, the emission is retained even when the voltage falls gradually to a level slightly lower than the aforementioned voltage $V_1$ till the applied voltage is lowered to a level $V_3$ below the flash starting voltage $V_1$. When no shutter release is made within the time $t_a$ after the voltage V of the main capacitor 22 charged with the output of the DC.DC converter 100 has reached the upper limit voltage $V_2$ and the oscillating operation of the DC.DC converter 100 has been consequently stopped, the voltage V of the main capacitor 22 is spontaneously discharged as shown in FIG. 4, when the voltage V has reached the aforementioned voltage $V_3$, at the point $t_6$, the neon lamp 9 is turnned off. In this case if the neon lamp 9 remains glowing nevertheless the main capacitor 22 is discharged spontaneously to a level below the lower limit voltage $V_1$ proper for emission of flash, there is a possibility that the photographer will mistake the glowing neon lamp 9 as an indication of completion of preparation of the camera for flash photographing. If emission of flash is conducted as it is, a photograph short of luminous energy is made. To preclude this possibility the present embodiment adopts a third timer 42 and controls charging by the time $t_0$, $t_a$, and $t_b$ as mentioned above. Thus, the present embodiment is not required to provide the neon lamp 9 with a forced OFF circuit. So long as the neon lamp 9 is kept on, the voltage of the main capacitor 22 is proper for flash photographing in the present invention.

Figure 8:
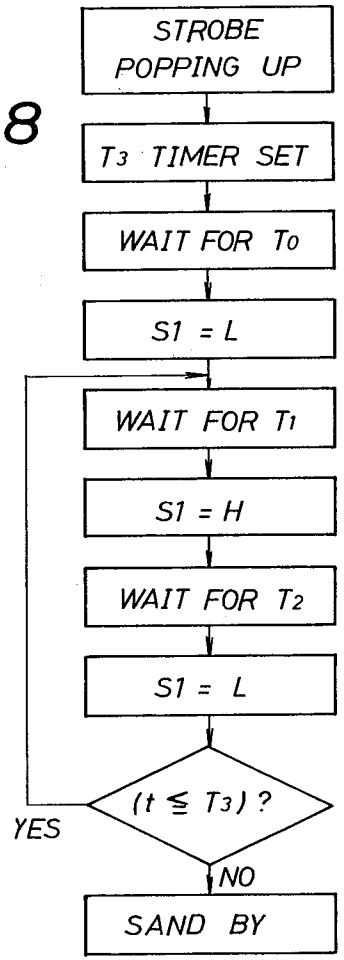
FIG. 8 is a flow chart illustrating the operation of the embodiment mentioned above.

Now, the second embodiment of this invention will be described below with reference to FIG. 6 through FIG. 8.

Figure 6:
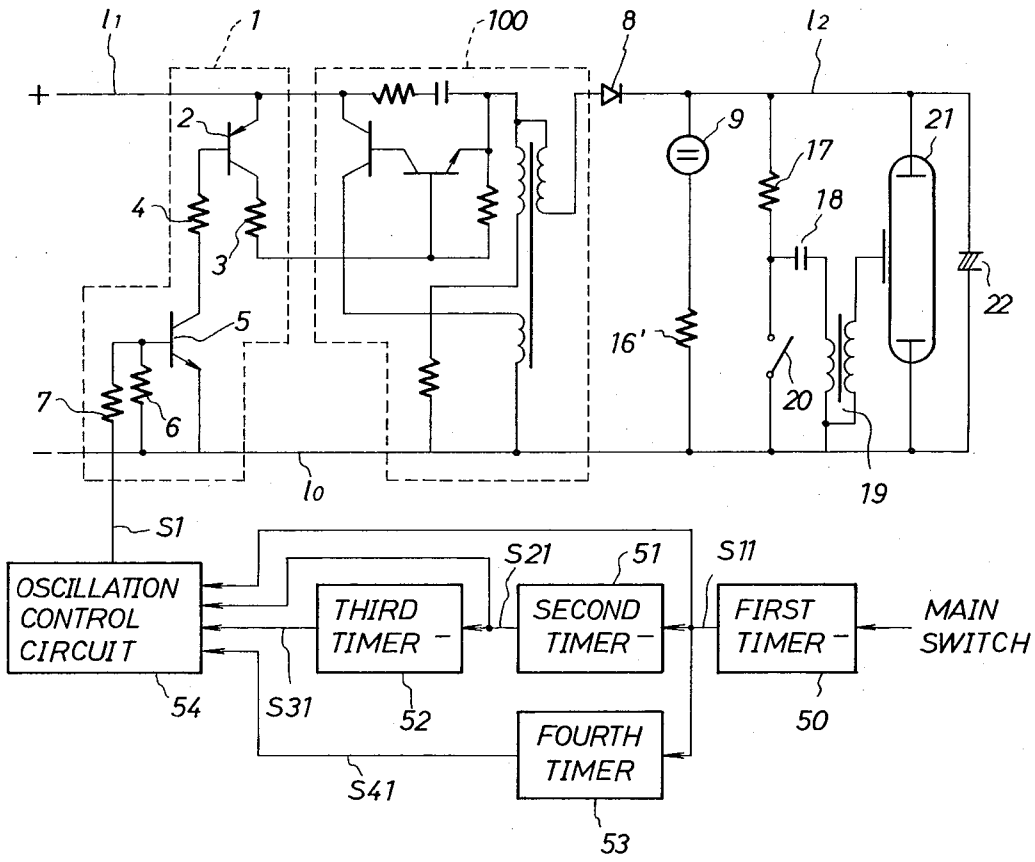
FIG. 6 is a diagram of a circuit of an apparatus for flash photographing as a second embodiment of the present invention.
Figure 7:
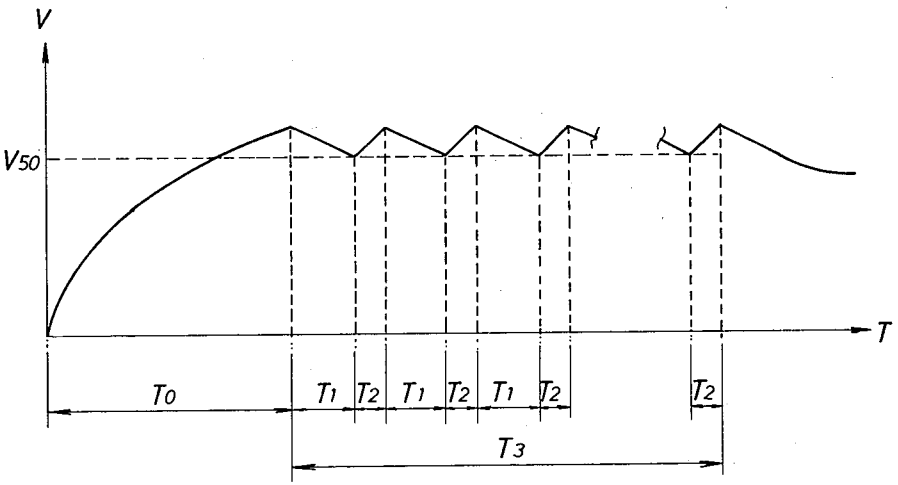
FIG. 7 is a schematic diagram used for explanation of the operation of the apparatus for flash photographing illustrated in FIG. 6.

The circuit shown in FIG. 6 is equal to that of FIG. 1, excepting a series circuit composed of a neon lamp 9 and a resistor 16' in place of the transistor 15 and the resistors **16*a*, 16*b***.

This embodiment is provided with a first timer 50 which is actuated for flash photographing by a main switch. This first timer 50 is actuated at a point at which the charging is started, and set for a time $T_0$ corresponding to the interval between this point and the point at which the voltage reaches the upper limit voltage below the withstand voltage of a stroboscope (as shown in FIG. 7).

The control signal S11 transmitted from the first timer 50 is supplied to a second timer 51. This second timer 51 is actuated at the point at which the voltage reaches the upper limit and set for a time $T_1$ corresponding to the interval between the point at which the voltage reaches the aforementioned upper limit voltage and a point at which the voltage reaches the lower limit voltage $V_{50}$ proper for emission of flash by spontaneous discharge. The control signal $S_{21}$ transmitted from this second timer 51 is supplied to a third timer 52. This third timer 52 is actuated at a point at which the voltage reaches the aforementioned lower limit voltage $V_{50}$ proper for emission of flash and is set for a time, $T_2$, corresponding to the recharging time between the point of the starting of the actuation and the point at which the voltage reaches a level between the aforementioned lower limit voltage $V_{50}$ and the withstand voltage of the aforementioned stroboscope.

The control signals S11, S21, and S31 transmitted respectively from the first, second, and third timers 50, 51, and 52 are supplied to the oscillation control circuit 54.

The control signal S11 transmitted from the first timer 50 is also supplied to a fourth timer 53. This fourth timer 53 is adapted to stop the charging of the main capacitor 22 when no shutter release is made within a fixed time, $T_3$, namely a fixed period, after lapse of which the photographer is considered not willing to use the flashlight. The control signal S41 which is transmitted from this fourth timer 53 is also supplied to the aforementioned oscillation control circuit 54.

In the apparatus for flash photographing of the present embodiment which is constituted as described above, when the main switch is turned on for conducting flash photographing, the first timer 50 is actuated and the control signal S11 is brought to the H level. By this control signal S11, the oscillation control circuit 54 is actuated and the oscillation control signal S1 is brought to the H level, and the DC.DC converter 100 is caused to start oscillating operation. As the result, the main capacitor 22 starts a charging operation and the voltage V thereof is gradually increased as illustrated in FIG. 7. This charging operation continues while the first timer 50 keeps counting the time $T_0$. On elapse of the time, $T_0$, the control signal S11 is brought to the L level and the transistors 5, 2 are both turned off by the oscillation control circuit 54, and the DC.DC converter 100 is caused to stop the oscillating operation. As soon as the aforementioned control signal S11 is brought to the L level, the second timer 51 is actuated to start counting the time $T_1$.

When the second timer 51 subsequently completes counting the time $T_1$, the control signal S21 is brought to the H level and the oscillation control signal S1 is brought to the H level by way of the oscillation control circuit 54, and the DC.DC converter 100 is caused to start the oscillating operation again. With the output of this DC.DC converter 100, the charging of the main capacitor 22 is started again.

When the input signal of the third timer 52 is brought to the H level, the third timer 52 is actuated to start counting the time $T_2$. After that the third timer 52 subsequently completes counting the time $T_2$, the control signal S31 thereof is brought to the L level, and the oscillation control signal S1 is brought to the L level by way of the oscillation control circuit 54, and the DC.DC converter 100 is caused to discontinue the oscillating operation. As a result, the second timer 51 is actuated again to repeat the charging and the discharging operation.

On the other hand, by the control signal S11 which is brought to the H level as soon as the first timer 50 completes counting the time $T_0$, the fourth timer 53 is actuated to start counting the time $T_3$. The reason for the adoption of the fourth timer 53 in the present embodiment is to discontinue the repeated operation of charging and discharging of main capacitor by the second timer 51 and the third timer 52.

Thus, the aforementioned second timer 51 and third timer 52 are adapted to be operated only when the fourth timer 53 is in the process of counting the time. As soon as the time $T_3$ elapses, the control signal S41 transmitted from the fourth timer 53 is brought to the H level and the oscillation control signal S1 is brought to the L level by way of the oscillation control circuit 54 and the oscillating operation of the DC.DC converter 100 is forcibly discontinued.

This invention is not limited to the embodiments described above but may be practised otherwise without departing from the spirit of the invention disclosed herein.

For example, the first timer may be adapted so as to be actuated at the starting of the charging and set for the time corresponding to the initial charging time between the starting of the charging and the point at which the voltage reaches the upper limit voltage below the withstand voltage of a stroboscope as described in the second embodiment. Otherwise, the first timer may be adapted so as to be actuated at the point at which the voltage reaches the voltage $V_1$ and set for the point at which the voltage reaches the upper limit voltage $V_2$ below the withstand voltage of the stroboscope as described in the first embodiment.

The second embodiment is constituted in order that the charging operation is forcibly discontinued when no flash photography is made after elapse of the time $T_3$ by fourth timer 53, it may be omitted.

All the embodiments concern a stroboscope of ordinary type. Of course, they may concern a stroboscope possessing an automatic light regulating function.

In the pop-up type apparatus in which the flashlight unit thereof is projected out of the camera, the apparatus may be constituted in order that the flashlight unit is actuated synchronously with a shutter release operation to reacharge the main capacitor while the flashlight is kept at the projected position.

What is claimed is:

1. An apparatus for conducting flash photographing by a camera capable of incorporating or setting therein a flashlight device and generating a trigger signal at full opening of a shutter, and a capacitor adapted to release electric charge stored therein in response to said trigger signal for a flash discharge tube to emit, said apparatus comprising;

a DC.DC converter for charging said capacitor by increasing voltage of a power source battery, a first timer adapted to be actuated when charging of said capacitor is started or when charging voltage reaches a predetermined level and set for a time at which charging voltage reaches upper limit voltage below withstand voltage of the flash discharge tube for initial charge, a second timer adapted to be actuated when charging voltage reaches said upper limit voltage and set for a time at which charging voltage reaches lower limit voltage for proper emission according to spontaneous discharge, a third timer adapted to be actuated when charging voltage is below the lower limit voltage and set for a time at which charging voltage reaches a level between the lower limit voltage and withstand voltage, and oscillation regulating means for turning said DC.DC converter off with output of said first timer, turning said DC.DC converter on with output of said second timer, and turning said DC DC converter off with output of said third timer.

* * * * *